United States Patent [19]

Sanford

[11] 4,342,322

[45] Aug. 3, 1982

[54] CIGARETTE FILTER

[75] Inventor: Robert A. Sanford, Prospect, Ky.

[73] Assignee: Brown & Williamson Tobacco Corporation, Louisville, Ky.

[21] Appl. No.: 219,132

[22] Filed: Dec. 22, 1980

[51] Int. Cl.[3] ..... A24D 3/04; A24D 3/00

[52] U.S. Cl. ..... 131/336; 131/338; 131/339; 131/340

[58] Field of Search ..... 131/336, 338, 339, 340, 131/341, 344

[56] References Cited

U.S. PATENT DOCUMENTS

| | | | |
|---|---|---|---|
| 3,389,705 | 6/1968 | Levavi | 131/339 |
| 3,490,461 | 1/1970 | Osmalov et al. | 131/336 |
| 3,910,288 | 10/1975 | Hammersmith et al. | 131/339 |
| 4,022,221 | 5/1977 | Berger | 131/340 |

FOREIGN PATENT DOCUMENTS

| | | | |
|---|---|---|---|
| 2849904 | 5/1979 | Fed. Rep. of Germany | 131/336 |

*Primary Examiner*—V. Millin

*Attorney, Agent, or Firm*—Charles G. Lamb

[57] ABSTRACT

A filter for a cigarette includes a porous filter rod having a hollow tube therein extending from one end a preselected distance, the filter rod being circumscribed by a non-porous wrapper wherein the filter rod with the non-porous wrapper therearound is provided with at least one groove extending from one end thereof a preselected distance longitudinally therealong. The groove and the tube may extend from the same one end or may extend from opposite ends. Tipping material circumscribes the non-porous wrapper and is provided with flow-throgh openings therein in flow communication with the groove. The groove may be oriented to extend to the mouth end of the filter or the tobacco end when connected to a cigarette.

9 Claims, 6 Drawing Figures

CIGARETTE FILTER

BACKGROUND OF THE INVENTION

1. Field of the Invention

This invention relates to filters for cigarettes. In one aspect it relates to a filter with novel ventilating means therein. In another respect the invention relates to a filter cigarette having ventilating air flow directing grooves therein. In even another respect the invention relates to a filter for a cigarette having smoke directing means therein in combination with novel ventilating air means.

2. Description of the Prior Art

It is well known in the art to add filters to cigarettes wherein the filters are provided with ventilating means to bring in ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough, thereby diluting the smoke in the stream. Also, the cigarette wrapper may be perforated at selected locations along the length of the cigarette which provides ports for the cigarette through which ventilating air enters. Even further, it is known to perforate the wrapper of the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by a tipping paper having flow-through perforations therein whereby ventilating air enters directly into the filter element or progresses down the grooves to the smoker's mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 2,302,677; British Pat. No. 1,414,745; British Pat. No. 1,360,612; British Pat. No. 1,360,611; and, U.S. Pat. No. 3,910,288, the aforementioned British patents being directed to non-wrapped acetate filters. Furthermore, there are a number of patents directed to the incorporation of centrally disposed tubes into a cigarette filter. These include, for example, U.S. Pat. No. 4,037,524; U.S. Pat. No. 4,086,846; U.S. Pat. No. 4,022,221; U.S. Pat. No. 3,045,680; U.S. Pat. No. 3,621,851; U.S. Pat. No. 3,674,036; and, U.S. Pat. No. 4,109,666.

SUMMARY OF THE INVENTION

The present invention advantageously provides a straight forward arrangement of a filter for a cigarette which in one form achieves normal cigarette pressure drop with low to moderate efficiency filters. The present invention further provides a cigarette filter for lowering tar predominantly by ventilation instead of filtration. The present invention even further provides a filter ventilation system for a cigarette utilizing grooves in the filter plug extending from tipping perforations in the tipping paper to one end of the filter. The present invention also provides a grooved filter with a non-porous plug wrap. The present invention even also provides means for directing the smoke stream in a filter to the center thereof while simultaneously therewith provides means for directing ventilating air along the outer surface thereof.

Various other features of the present invention will become obvious to those skilled in the art upon reading the disclosure set forth hereinafter.

More particularly, the present invention provides a filter for a cigarette comprising a porous filter rod of cylindrical configuration having a longitudinally extending tube centrally disposed therein extending a preselected distance from one end thereof; a non-porous wrapper extending longitudinally of and circumscribing the rod leaving flow-through opposed ends of the rod, the wrapper and rod having at least one longitudinally extending groove extending from at least one end a preselected distance therealong; and, tipping material extending longitudinally of and circumscribing the wrapper, the tipping material including flow-through openings therein in flow communication with the grooves.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT

Figure 1:
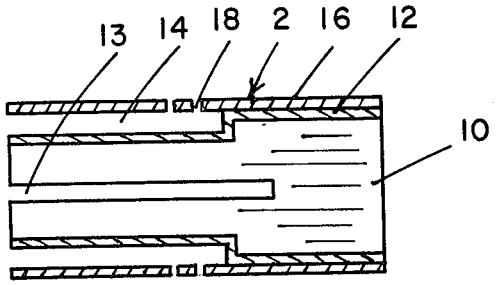
FIG. 1 is a cross-sectional view of one preferred filter element of the present invention.
Figure 2:
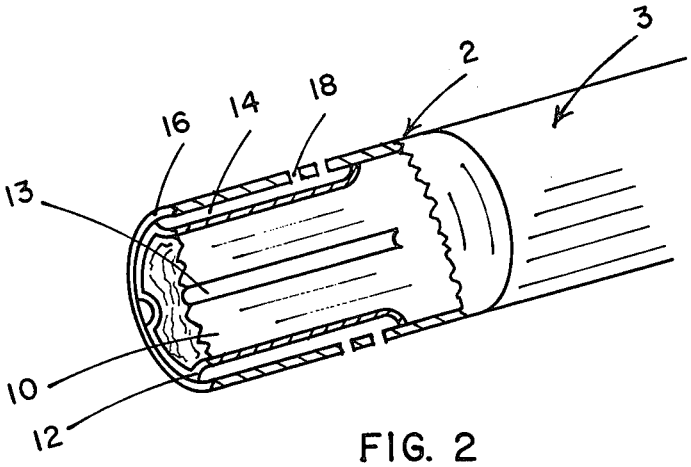
FIG. 2 is a perspective view with selected portions cut-away, of the filter element of FIG. 1 attached to a cigarette with the grooves directed toward the mouth end of the filter.
Figure 3:
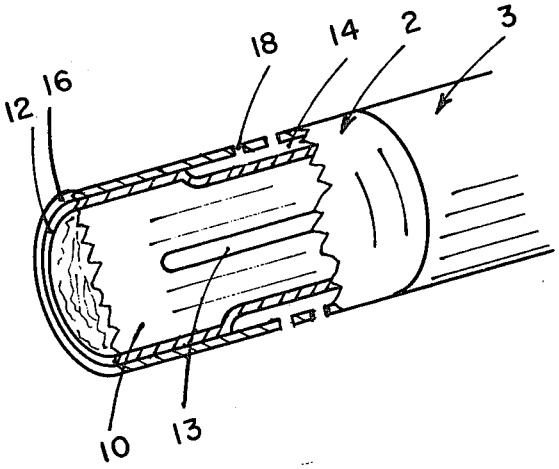
FIG. 3 is a perspective view with selected portions cut-away, of the filter element of FIG. 1 attached to a cigarette with the grooves directed toward the tobacco column of a cigarette.

In FIGS. 1, 2, and 3, a filter plug 2 of the present invention is shown. This filter plug 2 comprises a cellulose acetate filter element 10 or any other filter made from fibrous or foamed materials for tobacco smoke which may be known in the art circumscribed by a non-porous wrapper 12. It is realized that in the use of the term "non-porous wrapper", this includes non-porous outer surfaces of foamed material which are integral with the filter element as well as non-porous wrapping material which is not integral with the filter element. Disposed around the central axis and extending longitudinally from one end a preselected distance into the plug 2 is a hollow tube 13. Tube 13 is usually of a thin-walled, plastic material. Furthermore, the filter plug 2 is provided with a plurality of grooves 14 therein extending longitudinally therealong from the same end as the tube 13. The filter plugs 2 are generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art.

In FIGS. 2 and 3, the filter plug 2 is attached to a tobacco column or cigarette 3 and is positioned for being wrapped by tipping paper 16 which includes a plurality of perforations 18 therein circumferentially surrounding filter plug 2 and disposed for alignment with the grooves 14 wherein ventilating air radially enters the grooves 14 through the perforations 18. As shown in FIG. 2, ventilating air enters through the tipping perforations 18 traveling down the grooves 14 and toward the smoker's mouth whereas the filter plug 2 is turned around and the grooves 14 are positioned to introduce ventilating air into the tobacco column 3. Furthermore, in FIG. 2, tube 13 is disposed to concentrate the smoke in the central portion of the tube directing the smoke toward the mouth of the smoker, and in FIG. 3, concentrates the smoke leaving the tobacco column 3 in the center of the filter prior to filtration.

Figure 4:
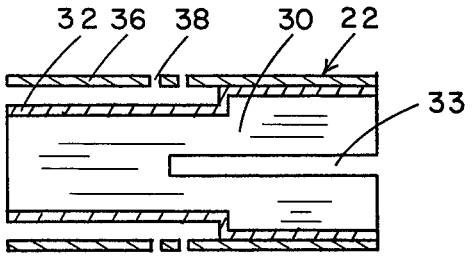
FIG. 4 is a cross-sectional view of another preferred filter element of the present invention.
Figure 5:
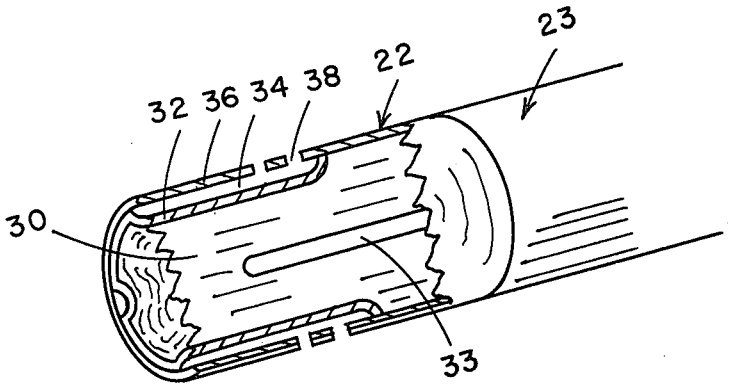
FIG. 5 is a perspective view with selected portions cut-away, of the filter element of FIG. 4 attached to a cigarette with the grooves directed toward the mouth end of the filter; and, FIG. 6 is a perspective view with selected portions cut-away, of the filter element of FIG. 4 attached to a cigarette wherein the grooves of the filter element are positioned for ventilating air to be directed toward the tobacco column.
Figure 6:
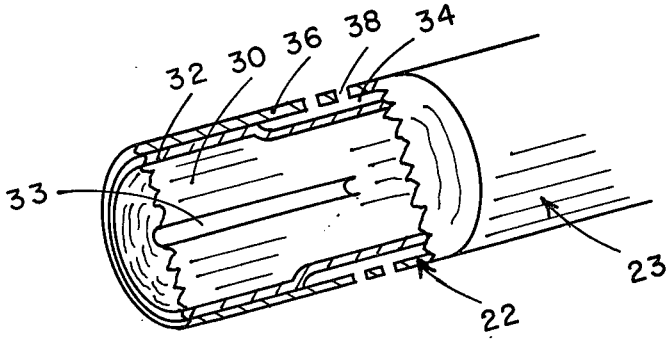

In FIGS. 4, 5, and 6, another filter plug of the present invention is shown identified by the numeral 22. This filter plug 22 also comprises a cellulose acetate filter element 30 or any other filter made from fibrous or foamed materials for tobacco smoke, such as filter element 10 discussed hereinbefore, circumscribed by a non-porous wrapper 32. Disposed around the central axis and extending longitudinally from one end a preselected distance into the plug 22 is a hollow tube 33. Furthermore, the filter plug 22 is provided with a plurality of grooves 34 therein extending longitudinally therealong from the opposite end as the tube 33.

In FIGS. 5 and 6, the filter plug 22 is attached to a tobacco column or cigarette 23 and is positioned for being wrapped by tipping paper 36 which includes a plurality of perforations 38 therein circumferentially surrounding filter plug 22 and disposed for alignment with the grooves 34 wherein ventilating air radially enters the grooves 34 through the perforations 38. As shown in FIG. 5, ventilating air enters through the tipping perforations 38 traveling down the grooves 34 and toward the smoker's mouth, whereas the filter plug 22 is turned around and the grooves 34 are positioned to introduce ventilating air into the tobacco column 23. Furthermore, in FIG. 5, tube 33 is disposed to concentrate the smoke in the central portion of the tube directing the smoke toward the tobacco column 23 and, in FIG. 6, concentrates the smoke in the center of the filter directing the smoke in a concentrated stream toward the smoker's mouth.

It will be realized that various changes may be made to the specific embodiments shown and described without departing from the principles of the present invention.

What is claimed is:

1. A filter for a cigarette comprising:

a porous filter rod of cylindrical configuration having a longitudinally extending tube centrally disposed therein extending a preselected distance from one end thereof;

a smoke impervious wrapper extending longitudinally along said rod from one end thereof and circumscribing said rod leaving flow-through opposed ends of said rod, said wrapper having at least one longitudinally extending groove embedded into the filter rod and that portion of the wrapper defining the groove remaining smoke impervious, said groove being open ended at and extending from one of said ends a distance less than the length of the filter rod; and, tipping material extending longitudinally of and circumscribing said wrapper, said tipping material being air pervious and permitting ventilating air flow therethrough into said groove, said ventilating air being the only fluid flowing through said groove when the filter is used in combination with a cigarette during normal smoke draw.

2. The filter of claim 1 wherein the open end of said tube and the open end of said groove are open on the same end of said filter rod.

3. The filter of claim 2 in combination with a cigarette, said groove and tube of said filter being in flow-communication with said cigarette.

4. The filter of claim 2 in combination with a cigarette, said groove and tube of said filter being open at the discharge end of said filter rod.

5. The filter of claim 1 wherein the open end of said tube and the open end of said groove are open at opposite ends of said filter rod.

6. The filter of claim 5 in combination with a cigarette, said groove being in flow-communication with said cigarette.

7. The filter of claim 5 in combination with a cigarette, said groove being open at the discharge end of said filter.

8. The filter of claim 1 wherein said tipping is impervious to air, said tipping material having selective perforations therein in flow-communication with said grooves.

9. The filter of claim 1, said non-porous wrapper being integral with said porous filter rod.

* * * * *